US005252244A

United States Patent [19]

Beaujean et al.

[11] Patent Number: 5,252,244

[45] Date of Patent: Oct. 12, 1993

[54] AQUEOUS ZEOLITE-CONTAINING LIQUID DETERGENT STABILIZED WITH AN ELECTROLYTE MIXTURE

[75] Inventors: Hans J. Beaujean, Hilden; Jens Bode, Duesseldorf; Stefan Paasch, Wolfenbuettel; Karl Schwadtke, Leverkusen; Eduard Smulders, Hilden; Eric Sung, Monheim, all of Fed. Rep. of Germany

[73] Assignee: Henkel Kommanditgesellschaft auf Aktien, Duesseldorf, Fed. Rep. of Germany

[21] Appl. No.: 838,443

[22] PCT Filed: Aug. 29, 1990

[86] PCT No.: PCT/EP90/01435

§ 371 Date: Mar. 6, 1992

§ 102(e) Date: Mar. 6, 1992

[87] PCT Pub. No.: WO91/03541

PCT Pub. Date: Mar. 21, 1991

[30] Foreign Application Priority Data

Sep. 6, 1989 [DE] Fed. Rep. of Germany ..... 3929591

[51] Int. Cl.[5] ..... C11D 3/04; C11D 3/10; C11D 3/12; C11D 17/08

[52] U.S. Cl. ..... 252/120; 252/118; 252/121; 252/122; 252/123; 252/131; 252/132; 252/140; 252/173; 252/174.14; 252/174.19; 252/174.21; 252/174.25; 252/540; 252/559; 252/DIG. 14

[58] Field of Search ..... 252/121, 122, 123, 131, 252/140, 173, 174.14, 174.15, 174.16, 174.19, 174.21, 174.25, 540, 559, DIG. 14, 117, 118, 132, 120

[56] References Cited

U.S. PATENT DOCUMENTS

| | | | |
|---|---|---|---|
| 4,083,793 | 4/1978 | Jakobi | 252/99 |
| 4,153,569 | 5/1979 | Brom | 252/109 |
| 4,265,777 | 5/1981 | Boyer | 252/113 |
| 4,280,920 | 7/1981 | Garvey | 252/173 |
| 4,405,483 | 9/1983 | Kuzel | 252/140 |
| 4,440,663 | 4/1984 | Boyer | 252/174.11 |
| 4,526,709 | 7/1985 | Boskamp | 252/527 |
| 4,530,780 | 7/1985 | Pas | 252/528 |
| 4,871,467 | 10/1989 | Akred | 252/135 |
| 4,929,380 | 5/1990 | Schulz | 252/121 |
| 4,965,014 | 10/1990 | Jeschke | 252/174.22 |

FOREIGN PATENT DOCUMENTS

| | | | |
|---|---|---|---|
| 3139858 | 4/1983 | Fed. Rep. of Germany | |
| 57-61618 | 4/1982 | Japan | 252/174.25 |
| 59-131522 | 7/1984 | Japan | 252/174.25 |
| 2176799 | 1/1987 | United Kingdom | 252/174.25 |

*Primary Examiner*—Dennis Albrecht

*Attorney, Agent, or Firm*—Ernest G. Szoke; Wayne C. Jaeschke; Real J. Grandmaison

[57] ABSTRACT

A phosphate-free liquid detergent containing anionic and nonionic surfactants, zeolite, and electrolyte system selected from carbonates, sulfates, chlorides, acetates and citrates with the proviso that the electrolyte system contain at least one carbonate and one sulfate, and water.

16 Claims, No Drawings

AQUEOUS ZEOLITE-CONTAINING LIQUID DETERGENT STABILIZED WITH AN ELECTROLYTE MIXTURE

This invention relates to a phosphate-free, water-based liquid detergent containing zeolite as builder and to a process for its production.

DISCUSSION OF THE RELATED ART

Liquid detergents containing builders are known in large numbers. In these water-based concentrates, even basically water-soluble builders, such as sodium tripolyphosphate for example, are partly undissolved and are present in the form of fine particles. In the interests of safety in use, liquid detergents of the type in question have to be formulated as stabilized homogeneous suspensions. If the tripolyphosphate is replaced by zeolite NaA, the problem of suspension stabilization also has to be solved for this insoluble and fine-particle component. To this end, it is proposed in German patent application 36 05 978 to suspend the zeolite particles in a non-aqueous liquid (liquid nonionic surfactant) and to increase the stability of the suspension by addition of the aluminium salt of a higher aliphatic carboxylic acid (aluminium tristearate). German patent application 36 25 189 describes non-aqueous, liquid universal detergents containing 25 to 45% by weight of one or more liquid nonionic surfactants, 10 to 20% by weight salts of nitrilotriacetic acid, 10 to 25% by weight zeolite and an anti-gelling agent, for example a nonionic surfactant reacted with succinic anhydride or an alkylene glycol monoalkyl ether, and aluminium tristearate as stabilizer.

U.S. Pat. No. 4,018,720 describes water-based liquid detergents containing 7 to 25% by weight of a mixture of alkyl sulfates or alkyl ether sulfates and alkyl benzenesulfonates, 6 to 25% by weight of a phosphate builder, 3 to 20% by weight of an alkali metal sulfate as stabilizer and, optionally, 1 to 10% by weight of an aluminosilicate as cobuilder. The sole use of alkyl zinc sulfonate as anionic surfactant leads to physically unstable compositions in the same way as the addition of solvents, such as alcohols or glycols.

Canadian patent application 1,202,857 describes stable, water-based liquid detergents containing 13 to 38% by weight zeolite, 5 to 40% by weight unsaturated $C_{16-22}$ fatty acid soap, 7 to 20% by weight surfactants, such as alkoxylated nonionic surfactants and amine oxides, 5 to 15% by weight water-soluble builders, such as polycarboxylates and pyrophosphate, and 30 to 70% by weight water. The detergents in question may also contain amphoteric and other anionic surfactants, including saturated soaps.

European patent application 75 976 describes alkaline water-based liquid detergents which contain 7 to 30% by weight zeolite, 5 to 40% by weight of an unsaturated $C_{16-22}$ fatty acid soap, 1 to 30% by weight of a nonionic surfactant, 5 to 15% by weight of a water-soluble polycarboxylate and 20 to 82% by weight water, but which are free from synthetic anionic surfactants because they would destabilize the perfume esters present in this stable liquid mixture.

European patent application 86 614 describes water-based liquid detergents containing anionic and/or nonionic, cationic and amphoteric surfactants, water-insoluble, suspended and optionally water-soluble builders and other electrolytes; sodium sulfate must not be present in quantities above 3% by weight. In the interests of stability, tripolyphosphate or mixtures of tripolyphosphate and other builder substances is/are preferably used as builder. Whereas phosphate-containing suspensions showed no signs of sedimentation, in some cases even after storage for 12 months at room temperature, phosphate-free detergents containing 13.4% by weight zeolite and 8.9% by weight silicate or 13.6% by weight zeolite and 9.0% by weight silicate as builders were stable in storage for only month at room temperature.

European patent application 142 185 describes stable water-based liquid detergents containing condensed phosphates and/or nitrilotriacetate together with zeolite NaY. The suspensions have a pH value of 7 to 9. The detergents contain 1 to 60% by weight surfactants, 0.5 to 30% by weight phosphate and/or nitrilotriacetate and 1 to 45% by weight zeolite. The surfactants may consist of anionic and nonionic surfactants which are preferably used in a ratio of 10:1 to 1:10. Zeolite NaA was found to be unsuitable for use in these detergents, distinct phase separation occurring after storage for only 15 days at room temperature.

European patent application 151 884 describes water-based liquid detergents containing builders, preferably phosphates, and surfactants in a ratio of at least 1.5:1 and also electrolytes. The quantity of electrolyte required to stabilize a certain predetermined suspension of water, surfactants and builders is determined by conductivity measurements. Where electrolyte salts are continuously added, the electrical conductivity passes through a first minimum in which the suspension is stable.

European patent application 170 091 also describes water-based liquid detergents containing surfactants, electrolytes - which include water-soluble builders, but which contain less than 3% by weight sodium sulfate - and suspended builders. In this case, too, tripolyphosphate is preferably used as the builder for the same reasons of stability as in European patent applications 86 614 and 151 884. The detergents can be separated into at least two phases, of which at least one is an aqueous phase, by centrifugation for 17 hours/25° C. at 800 times the earth's attraction. Stable detergents contain such quantities of dissolved electrolyte that 2 to 4.5 gram ions alkali metal ion per liter are present in the aqueous phase.

According to the teaching of European patent application 295 021, water-based, non-sedimenting, liquid crystalline surfactant concentrates, which can be transported and stored with no loss of stability, contain 25 to 80% by weight surfactants and up to 10% by weight, based on the quantity of surfactant, of electrolytes. However, sodium sulfate is only present in traces, if at all and - in the former case—is introduced into the concentrates as an impurity in the anionic surfactants. The concentrates may be rapidly diluted or made up into liquid detergents by addition of other detergent constituents, for example by addition of suspendable builders, preferably tripolyphosphate, and optionally electrolytes. The use of electrolytes with no builder properties is less preferred.

European patent application 301 882 describes a liquid detergent which may contain builders, such as phosphates and zeolite, and which contains viscosity-reducing (co)-polymers, for example polyethylene glycol, polyacrylates, polymaleates, polysaccharides and sulfonated polysaccharides. The polymers are only partly dissolved in the aqueous phase, the remainder being part of a phase dispersed in the aqueous phase. The detergents are regarded as sufficiently stable if no more than 2% phase separation occurs during storage for 21 days at 25° C.

The problem addressed by the present invention was to provide a phosphate-free, water-based zeolite-containing liquid detergent which is stable in storage for at least 3 months both at room temperature and at 40° C., does not have any tendency towards sedimentation, even during transport at temperatures of 5° to 60° C., and satisfies the performance requirements of modern liquid detergents.

DESCRIPTION OF THE INVENTION

Other than in the operating examples, or where otherwise indicated, all numbers expressing quantities of ingredients or reaction conditions used herein are to be understood as modified in all instances by the term "about".

Accordingly, the present invention relates to a phosphate-free zeolite-containing liquid detergent which contains 10 to 30% by weight anionic and nonionic surfactants, 10 to 25% by weight zeolite, 1 to 10% by weight of an electrolyte system consisting of at least two electrolytes from the group consisting of carbonates, sulfates, chlorides, acetates and citrates, and 40 to 60% by weight water, the electrolyte system consisting of at least one carbonate and one sulfate.

The detergents according to the invention preferably contain 5 to 20% by weight typical anionic surfactants from the class of sulfonates and sulfates. Preferred surfactants of the sulfonate type are $C_{9-13}$ alkyl benzenesulfonates, more particularly $C_{12}$ alkyl benzenesulfonate, and sulfonates based on oleochemicals, such as the esters of α-sulfonated fatty acids (ester sulfonates), for example the α-sulfonated methyl esters of hydrogenated coconut oil, palm kernel oil and tallow fatty acids. Suitable surfactants of the sulfate type are, for example, the sulfuric acid monoesters of primary alcohols of natural and synthetic origin, i.e. fatty alcohols such as, for example, coconut oil fatty alcohols, tallow fatty alcohols, oleyl alcohol, lauryl, myristyl, palmityl or stearyl alcohol, or $C_{10-20}$ oxoalcohols, and sulfuric acid monoesters of secondary alcohols having the same chain length, the sulfuric acid monoesters of primary alcohols based on oleochemicals being preferred. Sulfuric acid monoesters of alcohols ethoxylated with 1 to 6 mol ethylene oxide, such as linear $C_{12-18}$ fatty alcohols or 2-methyl-branched $C_{9-11}$ alcohols containing on average 3.5 mol ethylene oxide, are also suitable. Sulfated fatty acid monoglycerides may also be used. The sulfates and sulfonates may be present individually or in admixture. Preferred detergents contain 5 to 17% by weight and, more particularly, 8 to 16% by weight $C_{9-13}$ alkyl benzenesulfonates or 10 to 20% by weight of a mixture of $C_{9-13}$ alkyl benzenesulfonates with one or more other sulfonates and/or sulfates in any mixing ratio.

Other suitable anionic surfactants are soaps, preferably saturated fatty acid soaps, such as the salts of lauric acid, myristic acid, palmitic acid and stearic acid. Soap mixtures derived from natural fatty acids, for example coconut oil, palm kernel oil or tallow fatty acids, are particularly suitable. Soaps of which 50 to 100% by weight consist of saturated $C_{12-18}$ fatty acid soaps and 0 to 50% by weight of oleic acid soap are also suitable. The detergents according to the invention may contain 0 to 5% by weight soaps. Preferred detergents have a soap content of 1 to 3.5% by weight.

The anionic surfactants may be present in the form of their sodium, potassium or ammonium salts and also in the form of soluble salts of organic bases, such as mono-, di-or triethanolamine.

In addition, the detergents according to the invention preferably contain 5 to 10% by weight nonionic surfactants. Suitable nonionic surfactants are, for example, typical ethoxylated fatty alcohols, more particularly adducts of 2 to 7 mol ethylene oxide (EO) with linear primary alcohols, for example with coconut oil, tallow fatty or oleyl alcohol, or with 2-methyl-branched primary alcohols (oxoalcohols). More particularly, $C_{12-14}$ alcohols containing 3 EO or 4 EO, $C_{13-15}$ alcohols containing 3, 5 or 7 EO, $C_{12-18}$ alcohols containing 3, 5 or 7 EO and mixtures thereof, such as mixtures of $C_{12-14}$ alcohol containing 3 EO and $C_{12-18}$ alcohols containing 5 EO, are used in quantities of 5 to 9% by weight.

The detergents according to the invention contain zeolite NaA as builder. Other suitable builders are mixtures of zeolite NaA and NaX, the percentage content of the zeolite NaX in such mixtures best being below 30% and, more particularly, below 20%. Suitable zeolites contain no particles larger than 30 μm in size, at least 80% consisting of particles smaller than 10 μm in size. Their average particle size (volume distribution, as measured with a Coulter Counter) is in the range from 1 to 10 μm. Preferred zeolites have an average particle size of 2 to 4 μm. Their calcium binding power, as determined in accordance with German patent application 24 12 837, is in the range from 100 to 200 mg CaO/g. The zeolites, of which 10 to 25% by weight are present in the detergents according to the invention, may still contain excess alkali from their production. The zeolite content of the detergents according to the invention is preferably 12 to 20% by weight and, more preferably, 14 to 19% by weight. The ratio of surfactants to zeolite is preferably 0.8:1 to 1.4:1 and, more preferably, 1:1 to 1.4:1.

The suspensions according to the invention of water, surfactants and zeolite are stabilized by an electrolyte system which consists of at least two salts, preferably sodium salts and/or triethanolammonium salts, from the group consisting of carbonates, chlorides, sulfates, acetates and citrates, although it consists of at least one carbonate and one sulfate. The percentage content of the electrolyte system in the detergent as a whole is 1 to 10% by weight. 0.5 to 4% by weight and preferably 0.5 to 2% by weight of the electrolyte system consists of carbonate, 0.5 to 8% by weight and preferably 1 to 6% by weight of sulfate, 0 to 4% by weight and preferably o.1 to 2% by weight of chloride, 0 to 4% by weight and preferably 0.1 to 2.5% by weight of acetate and 0 to 1.5% by weight and preferably 0.1 to 1% by weight of citrate which is introduced into the suspension in the form of citric acid and which is formed by reaction with excess alkali. Preferred electrolyte systems consist of 3 or 4 different electrolytes, more particularly (based on the detergent as a whole) of 0.5 to 2% by weight sodium carbonate, 4 to 6% by weight sodium sulfate and 0.8 to 1.5% by weight citrate, for example sodium citrate or triethanolammonium citrate, or of 0.5 to 1.5% by weight sodium carbonate, 3.5 to 5.5% by weight sodium sulfate and 1.0 to 2.0% by weight sodium chloride or of 0.5 to 1% by weight sodium carbonate, 4 to 6% by weight sodium sulfate and 0.5 to 4% by weight sodium acetate or of 0.5 to 1% by weight sodium carbonate, 3 to 5.5% by weight sodium sulfate, 0.5 to 1.5% by weight sodium chloride and 0.5 to 2.5% by weight sodium acetate. The ratio of zeolite to the electrolyte system is preferably 10:3 to 10:6 and, more preferably, 10:4 to 10:5.

The detergents according to the invention contain 40 to 60% by weight and preferably 42 to 55% by weight water.

The pH value of the detergents is in the range from 8 to 12, preferably in the range from 8.5 to 10.5 and, more preferably, in the range from 9 to 10. The density of the detergents is from 1.1 to 1.25 g/ml and preferably from 1.15 to 1.22 g/ml. The detergents according to the invention have a yield point of at least 3 Pa. Preferred detergents have yield points of 4 to 35 Pa. Their viscosity (Brookfield viscosimeter, spindle No. 6, 10 r.p.m.) is in the range from 2,000 to 11,000 mPas, preferably in the range from 3,000 to 9,000 mPas and, more preferably, in the range from 3,500 to 8,500 mPas. The stability of the detergents in storage was tested over a period of 7 months both at room temperature and at 40° C. The detergents were stable in storage for at least 3 months. Some detergents stored for even longer periods showed no signs of sedimentation after 4 months and even after as long as 7 months. The detergents can be transported at temperatures of 5° to 60° C.

The foaming power of the surfactants can be reduced by the addition of 0.05 to 2% by weight non-surface-active organic substances. Suitable foam inhibitors are, for example, known polysiloxane/silica mixtures in which the fine-particle silica is preferably silanized. The polysiloxanes may consist both of linear compounds (silicone oils) and of crosslined polysiloxane resins and mixtures thereof. Other suitable foam inhibitors are paraffin oils, microparaffins and paraffin waxes. Mixtures of various foam inhibitors, for example mixtures of silicone oil and paraffin oil, may also be used with advantage. It is particularly preferred to use 0.1% by weight, based on the detergent as a whole, of silicone oil.

The detergents preferably contain 0.5 to 5% by weight alcohols containing 2 to 3 carbon atoms and 1 to 3 hydroxyl groups, such as ethanol, propanol, propylene glycol and glycerol. Propylene glycol and glycerol, either on their own or in admixture with ethanol, are preferably used in quantities of 2 to 3.5% by weight.

The detergents may also contain small quantities of free base, such as triethanolamine or sodium hydroxide, to keep the pH value in the range from 9 to 12.

In addition to the ingredients mentioned, the detergents may optionally contain other known additives of the type typically used in detergents, for example salts of polyphosphonic acids, optical brighteners, enzymes, bleaches stable in water-based detergents, hydrotropes and dyes and fragrances, in the usual quantities which do not affect the stability of the suspensions according to the invention.

The neutrally reacting sodium salts of, for example, 1-hydroxyethane-1,1-diphosphonate and diethylene triamine pentamethylene phosphonate are preferably used in quantities 0.1 to 1.5% by weight as the polyphosphonic acid salts. The total phosphorus content of the detergents as a whole is preferably less than 0.5%.

The detergents may contain derivatives of diaminostilbene disulfonic acid or alkali metal salts thereof as optical brighteners. Suitable optical brighteners are, for example, salts of 4,4'-bis-(2-anilino-4-morpholino-1,3,5-triazin-6-ylamino)-stilbene-2,2'-disulfonic acid or compounds of similar structure which, instead of the morpholino group, contain a diethanolamino group, a methylamino group, an anilino group or a 2-methoxyethylamino group. Brighteners of the substituted 4,4'-distyryl diphenyl type, for example the compound 4,4'-bis-(4-chloro-3-sulfostyryl)-diphenyl, may also be present. Mixtures of the brighteners mentioned above may also be used. The maximum content of brighteners in the detergents according to the invention is 0.5% by weight, quantities of 0.02 to 0.1% by weight preferably being used.

Suitable enzymes are those from the class of proteases, lipases, amylases or mixtures thereof. Their percentage content in the detergents may be from 0.2 to 1% by weight.

In one preferred embodiment, the detergents contain 8 to 16% by weight $C_{9-13}$ alkyl benzenesulfonate, more particularly $C_{12}$ alkyl benzenesulfonate, 1 to 3.0% by weight saturated $C_{12-18}$ fatty acid soap in the form of the sodium and/or triethanolammonium salts, 5 to 9% by weight nonionic surfactants, 14 to 19% by weight zeolite containing bound water, 0.5 to 1.5% by weight sodium carbonate, 3 to 6% by weight sodium sulfate, 0 to 1.5% by weight 1-hydroxyethane-1,1-diphosphonate and/or diethylenetriamine pentamethylene phosphonate, 0.1% by weight silicone oil and 43 to 54% by weight water.

In another preferred embodiment, the detergents contain surfactants, zeolite, phosphonate, silicone oil and water as above and also 0.5 to 1% by weight sodium carbonate, 4 to 6% by weight sodium sulfate, 1.5 to 2% by weight sodium acetate and 2 to 3% by weight glycerol or propylene glycol.

It is also preferred to use detergents containing surfactants, zeolite, phosphonate, silicone oil, sodium carbonate, sodium sulfate and water as above and also 0.8 to 1.5% by weight citrate, for example sodium citrate and/or triethanolammonium citrate, and 2 to 3% by weight glycerol or a mixture of 2/3rds glycerol and 1/3rd ethanol.

The invention also relates to a process for the production of the liquid detergents described above. The liquid detergents may be produced in known manner. To this end, 35 to 60% and preferably 40 to 58% water, based on the total quantity of water to be present in the detergent, and the foam inhibitor are preferably introduced into a reactor equipped with a stirrer system. The other components are added in such a way that large numbers of air bubbles are not stirred in. Where soap is to form part of the detergent, the corresponding fatty acid or the corresponding fatty acid mixture is heated to 60° to 80° C. and is stirred into the water introduced beforehand which has also been heated to 60° to 80° C. in this particular case. Thereafter, the fatty acid is best neutralized with triethanolamine and/or sodium hydroxide preferably added in the form of an aqueous solution. Zeolite NaA may be added both in the form of a powder and in the form of an aqueous suspension, the addition of a 40 to 55% by weight aqueous zeolite suspension being preferred. The electrolyte salts, carbonate and sulfonate and optionally chloride and acetate, may also be introduced in powder form or in the form of an aqueous solution.

EXAMPLES

EXAMPLE 1

This Example describes the production of a liquid detergent (D1) according to the invention in a 900 kg batch.

195.25 kg water and 0.9 kg silicone oil (silicone foam inhibitor VP 1132, a product of Wacker-Chemie GmbH) were introduced into an 800 l tank reactor. After the mixture of water and silicone oil had been heated to 70° C., 16.00 kg $C_{12}$ fatty acid (94%), which had also been heated to 70° C., were introduced.

The following components in the quantities indicated were added as further constituents:

150.00 kg of a 55% by weight aqueous solution of sodium dodecyl benzenesulfonate, 60.00 kg $C_{13-15}$ alcohol containing 7 ethylene oxide groups (EO), 305.00 kg of a 52% by weight aqueous zeolite suspension stabilized with tallow fatty alcohol containing 5 EO, 100.00 kg of a 50% by weight aqueous sodium sulfate solution, 10.00 kg of a 50% by weight aqueous sodium carbonate solution, 7.20 kg citric acid, 12.20 kg triethanolamine, 25.00 kg glycerol and 4.5 kg perfume, 0.45 kg optical brightener, 4.50 kg protease and 9.00 kg 1-hydroxyethane-1,1-diphosphonate disodium salt.

After mixing, the mixture was stirred for 20 minutes. The suspension obtained was degassed in vacuo (120 mm Hg column) to remove the air introduced during the dispersion process.

Density: 1.2 g/ml pH value: 9.20

Viscosity (Brookfield viscosimeter, spindle No. 6, 10 r.p.m.): 4,000 mPas

Yield point: 4.2 Pa

Stability in storage: The storage time was 7 months. In both cases, no sedimentation occurred over this period at storage temperatures of 40° C. and room temperature.

EXAMPLE 2

Further detergents D2 - D5 according to the invention were produced as in Example 1.

D2 contained 9.5% by weight dodecyl benzenesulfonate, 1.7% by weight $C_{12}$ fatty acid, 6% by weight $C_{13-15}$ alcohol containing 7 EO, 3% by weight $C_{12-14}$ alcohol containing 3 EO, 1.3% by weight triethanolamine, 17% by weight zeolite NaA, 2.0% by weight sodium carbonate, 4.0% by weight sodium sulfate, 1.0% by weight citric acid, 3% by weight glycerol and 52.05% by weight water. The storage time was 5 months. No sedimentation occurred over this period either at 40° C. or at room temperature.

D3 contained 14% by weight dodecyl benzenesulfonate, 8% by weight $C_{12-14}$ alcohol containing 5 EO, 0.5% by weight sodium hydroxide, 18% by weight zeolite NaA, 0.5% by weight sodium carbonate, 5.0% by weight sodium sulfate, 2.0% by weight sodium chloride, 2% by weight glycerol, 1% by weight ethanol and 47% by weight water. The storage time was 4 months. No sedimentation occurred over this period either at 40° C. or at room temperature.

D4 contained 10% by weight dodecyl benzenesulfonate, 1.8% by weight $C_{12-14}$ fatty acid, 1.4% by weight triethanolamine, 6% by weight of a mixture of $C_{12-18}$ alcohol containing 5 EO and $C_{12-14}$ alcohol containing 3 EO, 17% by weight zeolite NaA, 0.5% by weight sodium carbonate, 5.5% by weight sodium sulfate, 2.0% by weight sodium acetate, 3% by weight propylene glycol and 50.1% by weight water. The storage time was 5 months. No sedimentation occurred over this period either at 40° C. or at room temperature.

D5 was produced from 9.8% by weight dodecyl benzenesulfonate, 8.0% by weight $C_{12-14}$ alcohol containing 5 EO, 4.9% by weight $C_{12}$ fatty acid, 1.1% by weight sodium hydroxide, 17.5% by weight zeolite NaA, 2% by weight glycerol, 1% by weight ethanol, 0.5% by weight sodium carbonate, 6.0% by weight sodium sulfate, 0.9% by weight citric acid, 0.5% by weight protease, 0.1% by weight silicone oil and 47.7% by weight water. The storage time was 6½ months. No sedimentation occurred over this period either at 40° C. or at room temperature.

EXAMPLE 3

This Example describes the performance testing of detergent D1 according to the invention which was carried out under the following conditions in a domestic washing machine with a horizontally arranged drum (type Miele W 433):

Washing temperature: 60° C.

One-wash cylce—coloreds program

Water hardness: 16°d (d=German hardness, 160 mg CaO per liter)

Detergent dosage: 224 g

Fabric samples: two test strips with the same soils and 3.5 kg normally soiled domestic washing Fourfold determination.

The washing results were optically evaluated (Table 1) using a Zeiss reflectometer at 460 nm (blanking out of the brightener effect). Remission differences of 2% and more can be directly noticed by the user.

| Soil types: | |
|---|---|
| I | dust/sebum on cotton |
| II | dust/sebum on crease-resistant cotton |
| III | dust/sebum on polyester/crease-resistant cotton blend (50:50) |
| IV | dust/sebum on polyester |
| V | mineral oil on cotton |
| VI | tea on cotton |
| VII | red wine on cotton |
| VIII | cosmetics on crease-resistant cotton |

TABLE 1

| % Remission for soil | Initial value | D1 |
|---|---|---|
| I | 30.9 | 64.5 |
| II | 27.7 | 69.7 |
| III | 22.8 | 44.8 |
| IV | 30.4 | 71.7 |
| V | 17.4 | 74.6 |
| VI | 28.1 | 48.2 |
| VII | 28.7 | 55.4 |
| VIII | 22.4 | 65.7 |

The results are comparable with or better than those obtainable with commercially available products.

We claim:

1. A phosphate-free liquid detergent composition which is stable toward sedimentation at room temperature for at least 3 months consisting essentially of from about 10 to about 30% by weight of anionic and nonionic surfactants, from about 10 to about 25% by weight of zeolite, from about 0.5 to about 2% by weight of sodium carbonate, from about 4 to about 6% by weight of sodium sulfate, and from about 0.8 to about 1.5% by weight of citrate, and from about 40 to about 60% by weight of water, all weights being based on the weight of said detergent composition.

2. A phosphate-free liquid detergent composition which is stable toward sedimentation at room temperature for at least 3 months consisting essentially of from about 10 to about 30% by weight of anionic and nonionic surfactants, from about 10 to about 25% by weight of zeolite, from about 0.5 to about 1% by weight of sodium carbonate, from about 3 to about 5.5% by weight of sodium sulfate, from about 0.5 to about 1.5% by weight of sodium chloride, and from about 0.5 to about 2.5% by weight of sodium acetate, and from about 40 to about 60% by weight of water, all weights being based on the weight of said detergent composition.

3. A detergent composition as in claim 1 wherein said anionic surfactants are selected from the group consisting of $C_9$-$C_{13}$ alkyl benzenesulfonates, alcohol sulfates and ether sulfates, and are present in an amount of from about 5 to about 17% by weight of said detergent composition.

4. A detergent composition as in claim 1 wherein said anionic surfactants are selected from the group consisting of sodium and triethanolammonium saturated fatty acid soaps, and are present in an amount of from about 1 to about 3.5% by weight of said detergent composition.

5. A detergent composition as in claim 1 wherein said zeolite and said electrolyte system are present in a weight ratio of from about 10:3 to about 10:6, respectively.

6. A detergent composition as in claim 1 containing from about 5 to about 10% by weight of said nonionic surfactants.

7. A detergent composition as in claim 1 containing from about 0.5 to about 5% by weight of an alcohol selected from the group consisting of ethanol, propanol, propylene glycol, and glycerol.

8. A detergent composition as in claim 1 having a pH of from about 8 to about 12, and a yield point of at least about 3 Pa.

9. A detergent composition as in claim 1 wherein said surfactants and said zeolite are present in a weight ratio of from about 0.8:1 to about 1.4:1, respectively.

10. A detergent composition as in claim 2 wherein said anionic surfactants are selected from the group consisting of $C_9$-$C_{13}$ alkyl benzenesulfonates, alcohol sulfates and ether sulfates, and are present in an amount of from about 5 to about 17% by weight of said detergent composition.

11. A detergent composition as in claim 2 wherein said anionic surfactants are selected from the group consisting of sodium and triethanolammonium saturated fatty acid soaps, and are present in an amount of from about 1 to about 3.5% by weight of said detergent composition.

12. A detergent composition as in claim 2 wherein said zeolite and said electrolyte system are present in a weight ratio of from about 10:3 to about 10:6, respectively.

13. A detergent composition as in claim 2 containing from about 5 to about 10% by weight of said nonionic surfactants.

14. A detergent composition as in claim 2 containing from about 0.5 to about 5% by weight of an alcohol selected from the group consisting of ethanol, propanol, propylene glycol, and glycerol.

15. A detergent composition as in claim 2 having a pH of from about 8 to about 12, and a yield point of at least about 3 Pa.

16. A detergent composition as in claim 2 wherein said surfactants and said zeolite are present in a weight ratio of from about 0.8:1 to about 1.4:1, respectively.

* * * * *